US005294915A

United States Patent [19]

Owen

[11] Patent Number: 5,294,915

[45] Date of Patent: Mar. 15, 1994

[54] MEANS FOR LOCATING A REMOTE CONTROL DEVICE

[76] Inventor: C. Randal Owen, Rte. 2, Box 28, Bragg City, Mo. 63827

[21] Appl. No.: 85,669

[22] Filed: Jun. 30, 1993

Related U.S. Application Data

[63] Continuation of Ser. No. 813,650, Dec. 27, 1991, abandoned.

[51] Int. Cl.[5] ..... G08B 1/08

[52] U.S. Cl. ..... 340/539; 340/572; 340/825.49; 340/309.15; 340/692

[58] Field of Search ..... 340/539, 573, 531, 527, 340/825.69, 825.72, 825.49, 692, 528, 309.15, 568

[56] References Cited

U.S. PATENT DOCUMENTS

| | | | |
|---|---|---|---|
| 3,605,087 | 9/1971 | Philip | 340/692 |
| 4,101,873 | 7/1978 | Anderson et al. | 340/539 |
| 4,421,319 | 12/1983 | Murphy | 273/416 |
| 4,476,469 | 10/1984 | Lander | 340/825.49 |

FOREIGN PATENT DOCUMENTS

| | | | |
|---|---|---|---|
| 314469 | 12/1988 | Japan . | |
| 0314994 | 12/1988 | Japan | 340/825.49 |
| 171396 | 7/1989 | Japan . | |

*Primary Examiner*—Donnie L. Crosland
*Attorney, Agent, or Firm*—Haverstock, Garrett and Roberts

[57] ABSTRACT

A remote control locating device is disclosed which comprises a transmitter built into and hard wired into the circuitry of a remotely controlled electronic device and a receiver which is built into and hard wired into a remote control device which is capable of controlling the electronic device. The transmitter is adapted to operate on low power and is also adapted to transmit an FM signal upon operation of a switch. The receiver receives the FM signal transmitted from the transmitter and the receiver is also adapted to receive power from a battery contained in and adapted to power the remote control device. The receiver contains an audible signaling device adapted to be actuated upon receipt of the FM signal transmitted from the transmitter and the receiver further contains a timer adapted to deactivate the audible device upon expiration of a predetermined period of time for the purpose of saving battery usage.

10 Claims, 2 Drawing Sheets

MEANS FOR LOCATING A REMOTE CONTROL DEVICE

This is a continuation of co-pending application Ser. No. 07/813,650, filed on Dec. 27, 1991 now abandoned.

The present invention relates to a means for locating a remote control device and in particular to an audible means for locating a remote control device with the locating means including timing means.

Various electronic devices such as televisions, stereos, video cassette recorders and the like, are controlled from remote locations by use of a hand held remote control device. Remote control devices are capable of generating signals, such as infrared or RF, for transmission to the electronic device. The electronic device is adapted to receive the transmitted signal and based upon the received signal to operate a function of the electronic device, such as change a channel or increase the volume. Although remote control devices are useful, one problem associated with their use is that because of their size they are easily lost or misplaced. There have been various devices Proposed in the prior art for assisting in locating lost or misplaced objects some of which are disclosed in U.S. Pat. Nos. 4,101,873; 4,421,319; and 4,476,469. However, such devices are of complicated designs and would be expensive to implement in existing remote control devices and electronic devices. Therefore, it would be advantageous to have a means for locating a remote control device which is of simple design and could be easily incorporated within remote control devices and electronic devices.

SUMMARY OF THE INVENTION

The means for locating a remote control device of the present invention is designed and intended for use with a remote control device which is capable of controlling a typically stationary electronic device. The means for locating a remote control device comprises means located within the electronic device for selectively generating FM signals for transmission over an antenna, means located within the remote control device for receiving the FM signals, means responsive to the reception of the FM signals for generating audible signals that indicate the FM signals have been received, and means for timing a predetermined period of time and upon expiration of the predetermined period of time for deactiving the signaling means.

In general and in another form of the invention a remote control locating device comprises a transmitter build into and hard wired into the circuitry of a remotely controlled electronic device, the transmitter being adapted to operate on low power and being adapted to transmit an FM signal upon operation of a switch, and a receiver built into and hard wired into a remote control device which is capable of controlling the electronic device, the receiver being adapted to receive the FM signal transmitted from the transmitter, the receiver adapted to receive power from a battery contained in and adapted to power the remote control device, the receiver containing an audible signaling device adapted to be actuated upon receipt of the FM signal transmitted from the transmitter and the receiver further containing a timer adapted to deactivate the audible device upon expiration of a predetermined period of time for the purpose of saving battery usage.

In light of the foregoing comments, it will be recognized that a principal object of the present invention is to provide an improved means for locating a remote control device.

A further object of the invention is to provide a means for locating a remote control device which is of simple construction and design and which can be easily employed with highly reliable results.

These and other objects and advantages of the present invention will become apparent after considering the following detailed specification in conjunction with the accompanying drawings, wherein:

DETAILED DESCRIPTION OF THE PREFERRED EMBODIMENT

Figure 1:
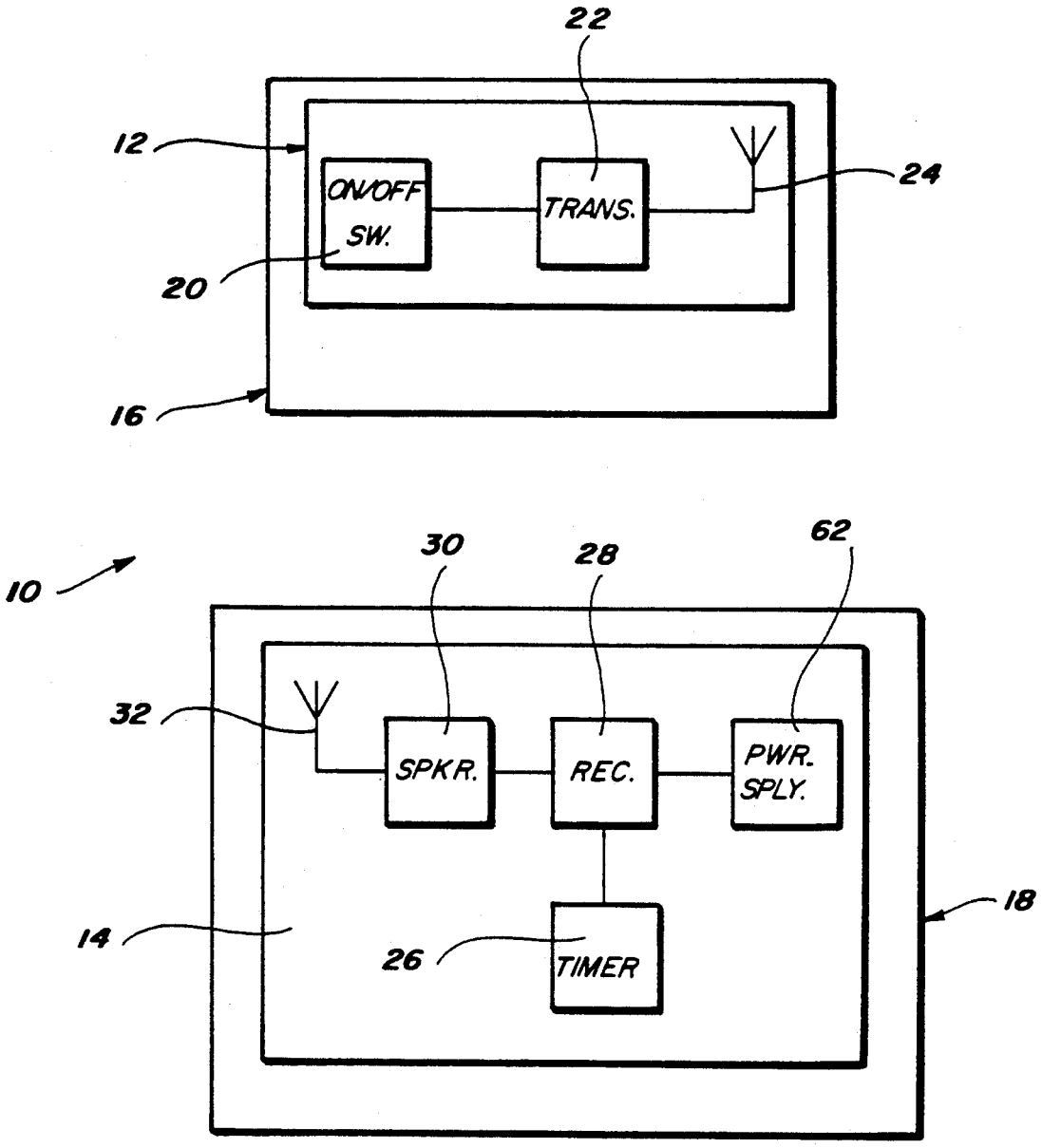
FIG. 1 is a block diagram of a preferred embodiment of means for locating a remote control device of the present invention.

Referring now to the drawings, wherein like numerals refer to like items, number 10 identifies a preferred embodiment of the means for locating a remote control device of the present invention. The locating means 10 includes a transmitter portion 12 and a receiver portion 14. The transmitter portion 12 is embodied or incorporated in an electrical or electronic device 16, such as a television, stereo system, VCR, or the like which is optionally controllable by a hand held remote control device 18. The receiver portion 14 is shown embodied or incorporated in the remote control device 18.

The transmitter portion 12 includes an On/Off switch 20, circuitry 22 connected to the switch 20 for transmitting Radio Frequency signals such as FM (frequency modulation) signals, and an antenna 24. The receiver portion 16 includes a timing means 26, circuitry 28 for receiving FM signals with such circuitry 28 being connected to the timing means 26, a signaling means 30, and an antenna 32.

As is known, the remote control device 18 controls functions associated with the electronic device 16. The electronic device 16 is typically a stationary device located at a single position. The hand held remote control device 18 is a relatively easily movable device which is capable of being positioned or taken to various locations remote from the electronic device 16 to operate the electronic device 16 from various locations. There are various methods of signaling between the electronic device 16 and the remote control device 18. One method is to use infrared signals which are transmitted from the remote control 18 and received by the electronic device 16.

Figure 2:
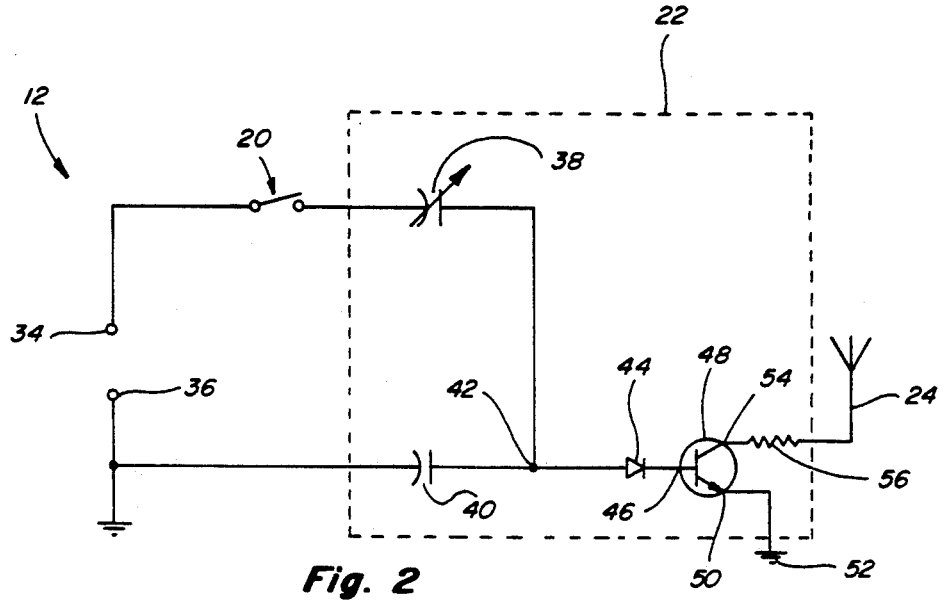
FIG. 2 is a schematic diagram of a transmitter portion of the means for locating a remote control device.

Referring now to FIG. 2, a schematic diagram of the transmitter portion 12 of the locating means 10 is shown. The transmitter portion 12 includes input terminals 34 and 36 which are connected to the power supply not shown) of the electronic device 16. The transmitter portion 12 may optionally be connected to a battery source (not shown). The switch 20 is connected in series with input terminal 34. The circuitry 22 for transmitting FM signals is connected between the switch 20 and the input terminal 36. The circuitry 22 includes a variable capacitor 38 and a capacitor 40 connected at a node 42 to a diode 44. The diode 44 is connected to the base 46 of a transistor 48 with the emitter 50 of the transistor 48 connected to ground 52 and the collector 54 of the transistor 48 connected to a resistor 56. The resistor 56 is connected to the antenna 24. Upon operation of the switch 20 power is supplied to the circuitry 22 which produces FM signals for transmission through the antenna 24. The frequency of the FM signals are selectable by use of the variable capacitor 38.

Figure 3:
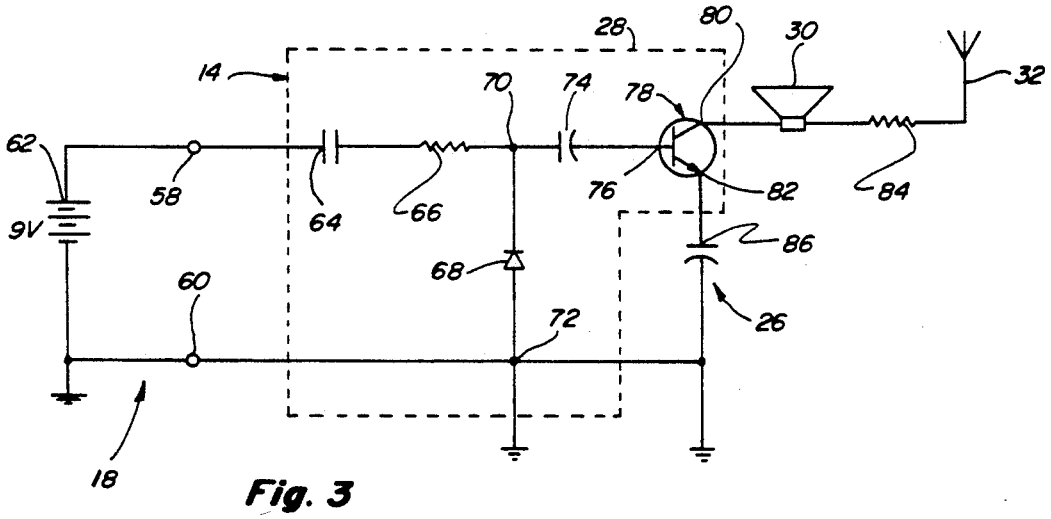
FIG. 3 is a schematic diagram of a receiver portion of the means for locating a remote control device.

FIG. 3 illustrates the receiver portion 14 of the locating means 10. The receiver portion 14 includes input terminals 58 and 60 which are connected directly to a battery supply 62 of the remote control device 18. The circuitry 28 for receiving FM signals is connected between the input terminals 58 and 60. The circuitry 28 includes a capacitor 64 connected in series with a resistor 66. A diode 68 is connected at nodes 70 and 72 in parallel between the series combination of the capacitor 64 and the resistor 66 and the input terminal 60. Also connected to node 70 is a capacitor 74 which is connected to the base 76 of a transistor 78. The collector 80 of the transistor 78 is connected to the signal means 30. The signal means 30 is an audible signal means such as a speaker. A resistor 84 is connected between the signaling means 30 and the antenna 32. The emitter 82 of the transistor 78 is connected to the timing means 26. The timing means 26 comprises a capacitor 86. Upon receiving transmission of FM signals from the tranmitting portion 12 power is supplied to the signal means 30 to operate the signal means 30. This also charges the capacitor 86 of the timing means 26. When capacitor 86 discharges this breaks the circuit and turns transistor 78 off which also turns off the signal means 30. The timing means 26 insures that the signaling means 30 is on for a predetermined period o time which is long enough for locating the remote control device 18 and short enough so that there is no drain on the battery supply 62.

For purposes of example, FIGS. 2 and 3 may be configured with the following component values:

| Component | Values |
|---|---|
| Capacitor 38 | Variable capacitor between 5 and 50 picofarads |
| Capacitor 40 | 220 microfarads, 16 V |
| Diode 44 | 1N181-1 |
| Transistor 48 | 224N1 |
| Resistor 56 | 100K ohms |
| Capacitor 64 | 22 microfarads |
| Resistor 66 | 100K ohms |
| Diode 68 | 1N181-1 |
| Capacitor 74 | 390 picofarads |
| Transistor 78 | 224N1 |
| Resistor 84 | 100K ohms |
| Capacitor 86 | 470 farads |

Figure 4:
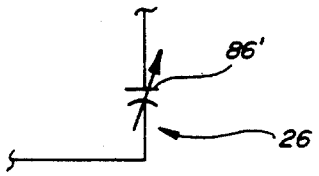
FIG. 4 is a partial schematic diagram similar to FIG. 3 showing another embodiment of timing means.

As can be appreciated, the time period in which the signaling means 30 is active may be selected by appropriate choice of the value of capacitor 86. It is preferred that the value of the capacitor 86 be selected such that the signaling means 30 is active for about 30 seconds. However, longer or shorter time periods may be used depending upon the user's experience with use of the locating means. Additionally, it is also possible that capacitor 86 be a variable capacitor such as capacitor 86' shown in FIG. 4. With variable capacitor 86' the user of the locating means 10 has the ability to easily select the time period that the signaling means 30 is active. If the user finds that 30 seconds is too short or too long a time period in which to locate the remote control 18, adjustment of the variable capacitor 86' is all that will be required.

In operation, when the user determines that the remote control device 18 has been misplaced or lost, the switch 20, located on the electronic device 12, will be operated to produce transmission of FM signals. The FM signals are then detected by the receiver portion 14 of the remote control device 18 and once detected the signaling means 30 will be activated. The user then locates the remote control device 18 within the time period in which the signaling means 30 is active. The signaling means 30 will deactivate after expiration of the predetermined time period.

From all that has been said, it will be clear that there has thus been shown and described herein a locating means for a remote control which fulfills the various objects and advantages sought therefor. It will be apparent to those skilled in the art, however, that many changes, modifications, variations, and other uses and applications of the subject locating means are possible and contemplated. All changes, modifications, variations, and other uses and applications which do not depart from the spirit and scope of the invention are deemed to be covered by the invention, which is limited only by the claims which follow.

What is claimed is:

1. A means for locating a remote control device which is capable of controlling an electronic device, the electronic device being stationary and the remote control device being capable of controlling the electronic device from a remote location, said locating means comprising means located within the electronic device for selectively generating FM signals for transmission over an antenna, means located within the remote control device for receiving the FM signals, means responsive to the reception of the FM signals for generating audible signals for a period of time that indicate the FM signals have been received, and means for selectively adjusting the period of time that the generating means are generating audible signals, the selectively adjusting means comprising a variable capacitor for selectively adjusting the period of time, and upon expiration of the selectively adjustable period of time for deactivating the generating means.

2. The locating means of claim 1 wherein selectively generating means comprises a variable capacitor for adjusting the frequency of the FM signals.

3. The locating means of claim 1 wherein selectively generating means comprises a switch for enabling transmission of the FM signals.

4. The locating means of claim 1 wherein the means for generating audio signals comprises a speaker.

5. The locating means of claim 1 wherein the electronic device includes a power supply and the means for generating FM signals is connected to the power supply.

6. The locating means of claim 1 wherein the remote control includes a power supply and the receiving means is connected to the power supply.

7. A remote control locating device comprising a transmitter built into and hard wired into the circuitry of a remote controlled electronic device, the transmitter being adapted to operate on low power and being adapted to transmit an FM signal upon operation of a switch, and a receiver built into and hard wired into a remote control device which is capable of controlling the electronic device, the receiver being adapted to receive the FM signal transmitted from the transmitter, the receiver adapted to receive power from a battery contained in and adapted to power and the remote control device, the receiver containing an audible signaling device adapted to be actuated upon receipt of the FM signal transmitted from the transmitter and the receiver further containing a manually adjustable timer adapted to deactivate the audible device upon expiration of an adjustable period of time for the purpose of saving battery usage, the manually adjustable time comprising a variable capacitor for manually adjusting the adjustable period of time.

8. The remote control locating device of claim 7 wherein the audible signaling device comprises a speaker.

9. A means for locating a remote control device which is capable of controlling an electronic device, the electronic device being stationary and the remote control device being capable of controlling the electronic device from a remote location, said locating means comprising means located within the electronic device for selectively generating signals for transmission over an antenna, means located within the remote control device for receiving the signals, means responsive to the reception of the signals for generating audible signals for a period of time that indicate the signals have been received, and means for manually selecting the period of time the generating means are generating audible signals and upon expiration of the manually selected period of time for deactivating the signaling means.

10. The locating means of claim 9 wherein selectively generating means comprises a variable capacitor for adjusting the frequency of the signals.

* * * * *

UNITED STATES PATENT AND TRADEMARK OFFICE

CERTIFICATE OF CORRECTION

PATENT NO. : 5,294,915

DATED : March 15, 1994

INVENTOR(S) : C. Randal Owen

It is certified that error appears in the above-indentified patent and that said Letters Patent is hereby corrected as shown below:

Column 2, line 61, "not shown) should be --(not shown).

Column 3, line 34, "o" should be --of--.

Column 5, line 2, delete the second occurrence of --and--.

Column 5, line 9, "time" should be --timer--.

Signed and Sealed this

Fifth Day of July, 1994

*Attest:*

*Attesting Officer*

BRUCE LEHMAN

*Commissioner of Patents and Trademarks*